United States Patent [19]

von Schuckmann

[11] Patent Number: 4,844,267

[45] Date of Patent: Jul. 4, 1989

[54] CLOSURE CAP FOR INFUSION AND TRANSFUSION BOTTLES

[75] Inventor: Alfred von Schuckmann, Kevelaer, Fed. Rep. of Germany

[73] Assignee: Franz Pohl Metall- und Kunststoffwarenfabrik GmbH, Karlsruhe, Fed. Rep. of Germany

[21] Appl. No.: 187,558

[22] Filed: Apr. 28, 1988

[30] Foreign Application Priority Data

May 7, 1987 [DE] Fed. Rep. of Germany ..... 3715175

[51] Int. Cl.[4] ..... B65D 51/18

[52] U.S. Cl. ..... 215/253; 215/305

[58] Field of Search ..... 215/247, 249, 251, 253, 215/305

[56] References Cited

U.S. PATENT DOCUMENTS 3,200,982 8/1965 Cormier ..... 215/253
3,278,063 10/1966 Kranzhoff ..... 215/247 X
3,285,451 11/1966 Golde ..... 215/305
4,205,754 6/1980 Nielsen et al. ..... 215/249

FOREIGN PATENT DOCUMENTS 624472 1/1936 Fed. Rep. of Germany .
2040937 6/1972 Fed. Rep. of Germany .
3130246 2/1983 Fed. Rep. of Germany .
3336344 5/1985 Fed. Rep. of Germany .

*Primary Examiner*—Donald F. Norton
*Attorney, Agent, or Firm*—Martin A. Farber

[57] ABSTRACT

A closure cap for infusion and transfusion bottles having a rim cap which grips around a rim neck of a bottle and has a cutout which is closed by a plastic lid so that an annular zone of the plastic lid grips below the edge of the cutout to obtain a tightly sealed attachment of the lid this attachment can nevertheless be lifted off with relatively little force due to a radially extending intended-bend line of the plastic lid formed by a thinning of the material.

9 Claims, 7 Drawing Sheets

CLOSURE CAP FOR INFUSION AND TRANSFUSION BOTTLES

FIELD AND BACKGROUND OF THE INVENTION

The invention refers to a closure cap for infusion and transfusion bottles, having a rim cap which surrounds a rim neck of the bottle and has a central cutout which is closed by the central region of a plastic lid in such a manner that an annular region of the plastic lid engages below the edge of the central cutout.

A closure cap of this type is known from Federal Republic of Germany Pat. No. 20 40 937. By the pulling off of the plastic lid the central cutout is free for introducing an injection needle, transfusion fitting or the like through a disk-shaped closure stopper inserted in the rim neck. For reasons of the indispensable aseptic character of the transition region between plastic lid and rim cap there must be present, on the one hand, an effective septic barrier which is provided there by a sealing joint of the nature of an annular groove. The form-fitting surrounding of the central cutout by the viscoelastic plastic of the lid requires, on the other hand, a relatively large opening force, for which reason a pull tab which is adapted approximately to the area of the central cutout is developed on the top of the plastic lid. This tab lies decentrally on and extends, cantilevered above the said central region in a close parallel neighboring relationship to the top side of the lid. This, however, requires complicated measures of molding technique. In order to bring the pull tab into a position suitable for gripping, it must be bent off by an angle of practically about 90 degrees. This entails a not inconsiderable risk of it being torn off; without such a pull tab the removal of the plastic lid is fundamentally still possibly only by the use of auxiliary tools. However, this can lead to damage to the neck of the bottle.

It is the object of the present invention so to develop a closure cap of this type in a manner which is simpler to manufacture and more dependable in use, without any sacrifice in the sealing properties, in such a manner that the closure cap can be removed more easily despite the fact that it is more firmly attached to the rim cap.

SUMMARY OF THE INVENTION

According to the invention the plastic lid has at least one radially extending intended-bend line which is formed by a thinning of material.

As a result of this development, there is created a closure cap of this type which takes into account the basic requirements of aseptic sealing but can nevertheless be opened by the operator with the use of less force. This is achieved in simple manner by at least one radially extending intended-bend line in the plastic lid, this line being formed by a thinning of the material. Grasping the edge of the plastic lid, the lid is simply swung partially upward, defined by the said intended-bend line, around said line. Since it intersects the central region, there is produced thereby a one-half prying out of the annular zone of the attachment there which sealingly surrounds the edge of the central cutout, as well as a slight pulling out of the balance. Depending on the color of the plastic material used, even the resultant so-called "white break" can be used in this connection for visual control, namely as to whether the infusion is or was already in use or not. Such an "original closure" indication undoubtedly increases safety in the field of medical use. In order not to be limited to a given region of action, several of the aids for opening described can be provided on the closure cap, for instance by a plurality of intended-bend lines provided at equal angles from each other and extending from the edge of the plastic lid up to the central region. In this way there are produced a plurality of main regions for the introducing of the lever-action swinging up of the plastic lid followed by the pulling out of the remaining sealing section of the side of the annular zone. In order to make the regions of attacks clearly visible and furthermore also to obtain an enlarged area of action it is furthermore proposed that the plastic lid have at least one grip tab which protrudes beyond the edge of the rim cap. For reasons of molding technique, this grip tab can be seated at the height of the bottom surface of the cup-shaped plastic lid. Furthermore, in another advantageous embodiment bend lines which correspond to the diametrally extending intended-bend line are provided parallel to the latter. Another advantageous variant resides therein that the groove extends also through the annular zone, the region circumscribed by it and the wall of the plastic lid. The bending is thereby further facilitated. Finally, the invention also provides an embodiment in which a circumferential tear line is located outside the edge of the central cutout below which the annular zone engages in the cover of the rim cap. By the prying off of the plastic lid, the region of attachment of the rim cap which may suitably consist of aluminum is also lifted out in this embodiment. In order to assure conditions of separation which are as identical as possible on practically all sides, it has furthermore been found advantageous for the tear line to extend concentrically to the edge of the central cutout. The tear line can be produced at the same time as the deepdrawing of the rim cap. In general a notch-shaped annular groove is sufficient.

BRIEF DESCRIPTION OF THE DRAWINGS

With the above and other objects and advantages in view, the present invention will become more clearly understood in connection with the detailed description of preferred embodiments, when considered with the accompanying drawings, of which.

DETAILED DESCRIPTION OF THE PREFERRED EMBODIMENTS

Figure 2:
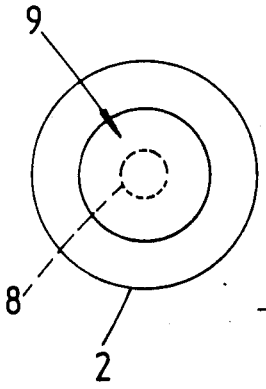
FIG. 2 is a top view thereof.
Figure 1:
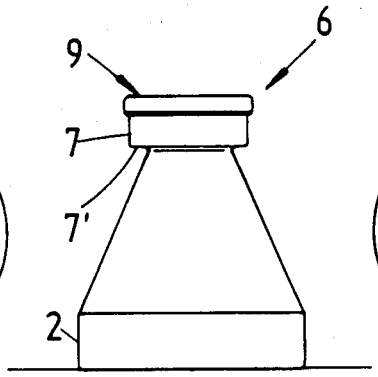
FIG. 1 is a side view of an infusion bottle provided with the closure cap of a first embodiment of the invention, in accordance with the first embodiment.
Figure 3:
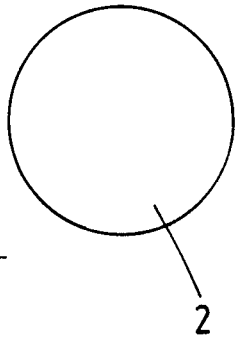
FIG. 3 is a bottom view of the infusion bottle.
Figure 4:
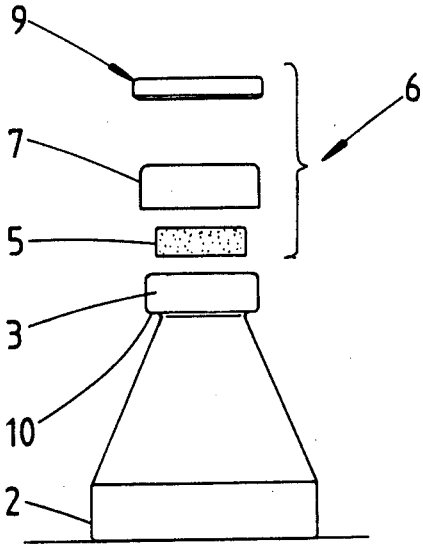
FIG. 4 is an exploded view of FIG. 1 showing the individual parts of the cap.

A bottle 2 which contains an infusion or transfusion liquid 1 passes via a frustoconically tapering section into the so-called rim neck 3. Due to a corresponding offset of the wall, the neck forms an inner annular shoulder 4 upon which the edge of a disk-shaped closure stopper 5 rests. The latter consists of rubber, plastic or other material which can be pierced by a cannula and closes itself automatically.

The relatively thick-walled closure stopper 5 terminates substantially flush with the end surface 3' of the rim neck 3.

The aseptic closure is formed by a closure cap 6 which is placed on top thereof. The cap 6 consists of a cup-shaped rim cap 7 having a central middle cutout 8 which is covered by a plastic lid 9.

The rim cap 7 has a cylindrical cup wall, the edge of which engages the underside of an annular shoulder 10 on the rim neck 3. The rim cap 7 is formed of relatively thin-walled aluminum. The edge of the rim cap 7 which engages the underside of the shoulder 10 is designated 7'.

The bottom of the cap 7 which forms the cover 11 of the cup-shaped rim cap 7 is flat. The edge of the central cutout 8 which is arranged therein passes into an inverse flanging so that this edge is transversely rounded and is developed practically with a double wall over a short radial length. The annular collar which is thereby produced bears the reference number 12. Its inner side lies against the bottom side of the cover 11.

The connection between the rim cap 7 and the plastic lid 9 which is also shaped in cup shape can be produced by thermal riveting or else directly upon the injection molding. In the case of thermal riveting, the plastic lid 9 forms, lying centrally, a vertical collar 13 which extends in the direction towards the bottle and the outside diameter of which corresponds to the inside diameter of the circular central cutout 8. The cylindrically shaped vertical collar 13 passes upon assembly through the said central cutout 8, whereupon the protruding collar section 13' is bent over in outward direction. The corresponding region of the connection is airtight and thus constitutes an active barrier against germs. Fundamentally the edge of the central cutout 8 then lies there in an annular groove.

The outer wall of the rim cap 7 is only partially closely gripped over by the cylindrical wall 9' of the plastic lid 9, namely over about one-third of its axial length. The cup wall 9' of the plastic lid 9 is many times thicker than the wall of the rim cap 7. The same is true basically of the thickness of the cover 9'' of the plastic lid 9.

Figure 5:
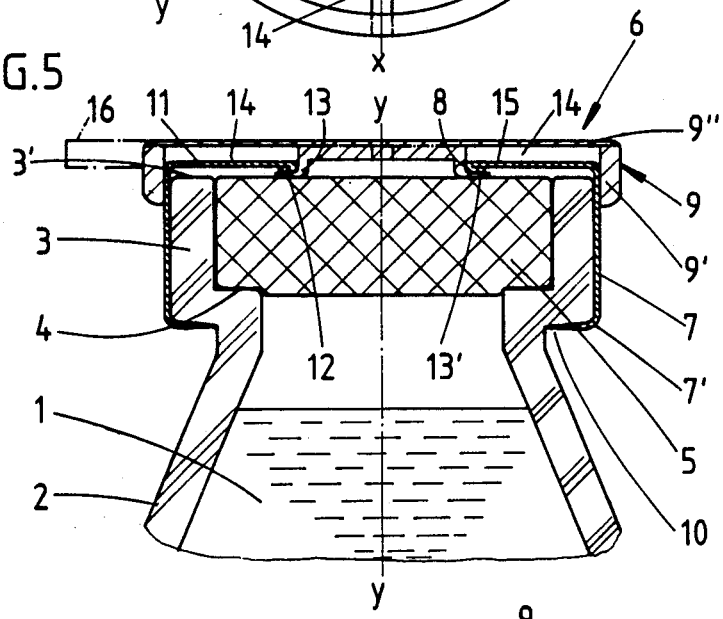
FIG. 5 is a vertical section through the cap-equipped rim neck of the infusion bottom, in a view considerably enlarged as compared with FIG. 1.
Figure 9:
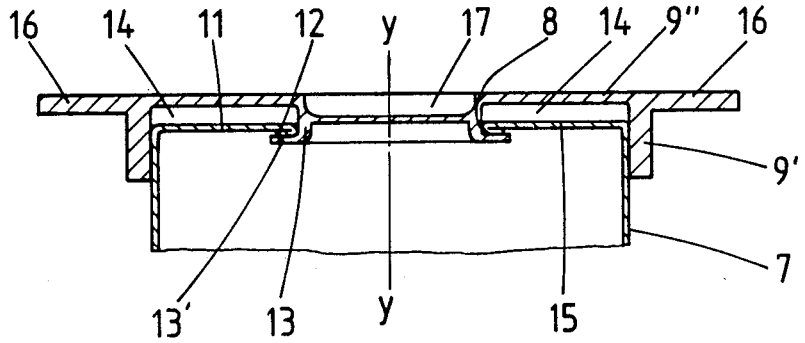
FIG. 9 is a view of the plastic lid in condition connected to the rim cap seen along the section line IX—IX in FIG. 8.

In order to remove the infusion liquid 1 for use it is merely necessary to remove the plastic lid 9. This means eliminating the attachment between it and the rim cap 7, the annular surface of which engages over the closure stopper 5 in its edge region (the gap-like spacing shown in FIGS. 5 and 9 is greatly exaggerated for reasons of clarity of the drawing). The corresponding loosening of the plastic cap 9 is facilitated by at least one radially extending intendedbend line x—x of the plastic lid 9 which is formed by the thinning of the material. The intended bend lines x—x are formed by a groove 14. It is located on the bottom 15 of the plastic lid 9. The grooves 14 commence at the height of the outer wall of the centrally located annular collar 13 and extend, seen in extension, in diametral direction and therefore intersecting the longitudinal central axis y—y of the bottle 2 which is developed with rotational symmetry, to the cylindrical inner surface of the cup wall 9'. The groove can also lie on the top side of the lid.

Figure 6:
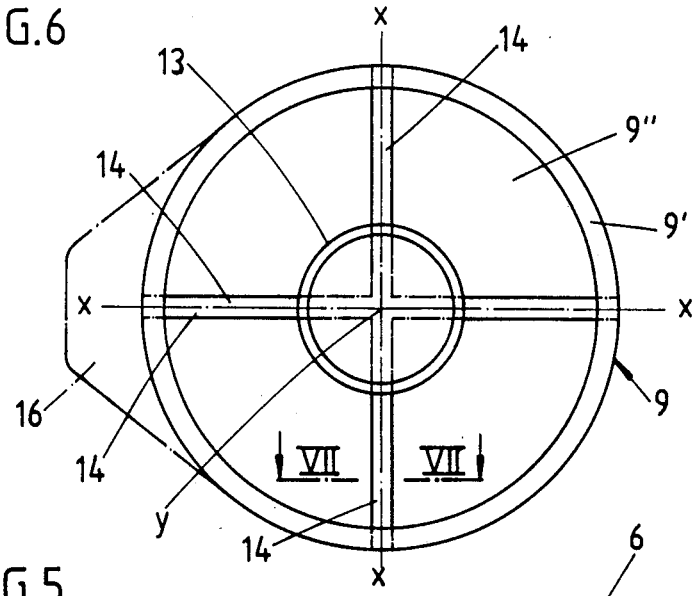
FIG. 6 shows the plastic lid by itself, seen from the bottom.
Figure 7:
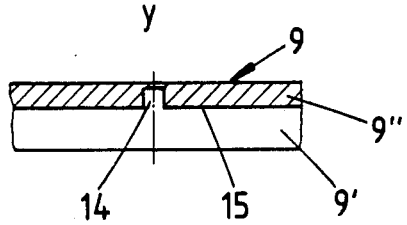
FIG. 7 is a section along the line VII—VII in FIG. 6.

The depth of the groove corresponds to about four-fifths of the thickness of the cover 9'' of the plastic lid 9. The width of the groove 14 corresponds to its depth (see FIG. 7). With an equal-angle arrangement of a total of four grooves 14 two of which in each case extend in linear direction intersecting the longitudinal center axis y—y which is shown in FIG. 6, fold halves result upon the bending up. Thus is based on a favorable long lever arm which lifts out, the annular collar 13 which forms the attachment section halfway, precisely defined. The remaining lifting out takes place accordingly without any great use of force. This half can be pulled out practically parallel to the groove.

With plastic lids with top grooving, the regions of action can be recognized visually. However, if, as described in the embodiment, the grooving is arranged on the bottom side of said lid, then it is favorable for operation that the plastic lid 9 have at least one grip tab 16 protruding horizontally beyond the rim edge 7' of the rim cap 7 (in this way the rather small edge of the lid need not be grasped). There are concerned here visor-shaped like developments extending at the height of the cover 9'', which furthermore lead to an even larger length of lever arm. The grip tabs 16 protrude in each case perpendicular to the diametral intended-bend line x—x. Their free ends are terminated parallel to said line. Their sides 16' extend as convex arcuate sections tangentially into the outer surface of the cup wall 9'. In the case of the arrangement by fours of the grooves 14 which is used in FIGS. 6 and 8, grip tabs 16 have a substantially trapezoidal contour. The larger base surface is rooted in the outer wall and assumes a correspondingly curved course. As seen in plan view there is practically a circle within a square. The side flanks 16' there of the grip tabs 16 therefore are at a right angle to each other.

In order to also circumscribe the region by the annular collar 13 and to make the annular collar itself more easily bendable, the grooves 14 can be continued as alternative in the same direction within the circumscribed inner surface and also furthermore include the cup wall 9' of the plastic lid 9 (see FIG. 6, entry in dot-dash line). The corresponding grooving separates up into the corresponding cup edge. On the other hand, however, and there is also the possibility of recessing, by thinning of the material, the entire back of this surface, as shown in FIG. 9. The corresponding top cutout is provided with the reference number 17. The cutout can also be at the bottom. The web which remains corresponds to the thickness of the remaining bridge of material in the cross-sectional region of the groove 16.

Figure 10:
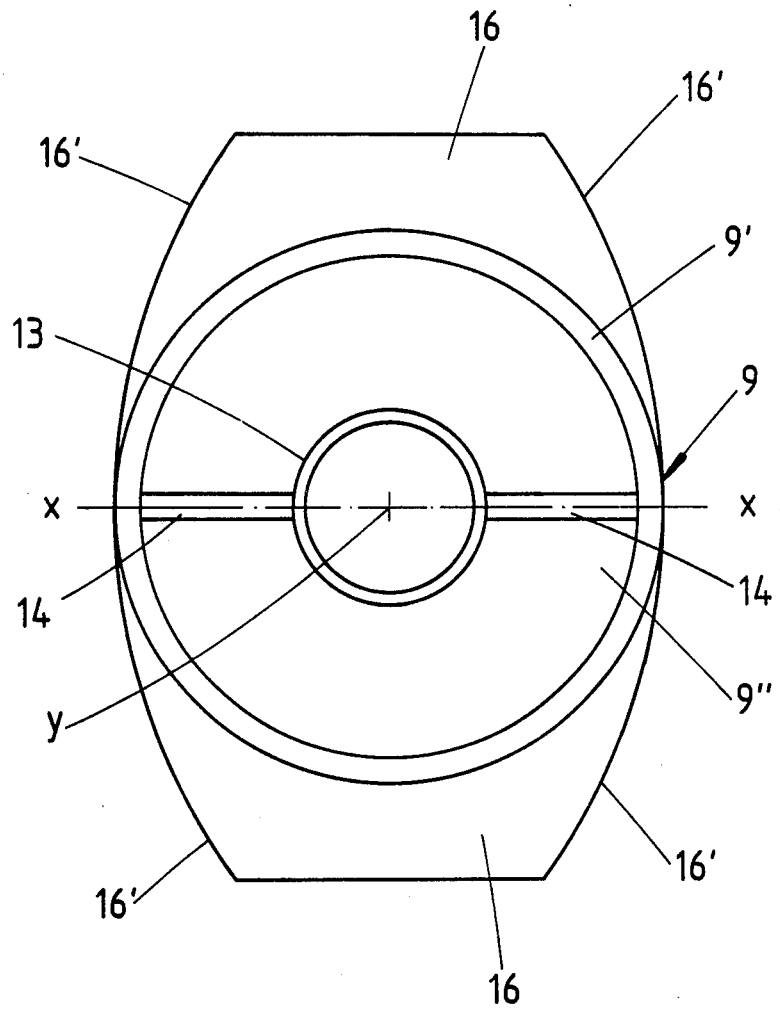
FIG. 10 is a bottom view of another variant of the plastic lid.
Figure 11:
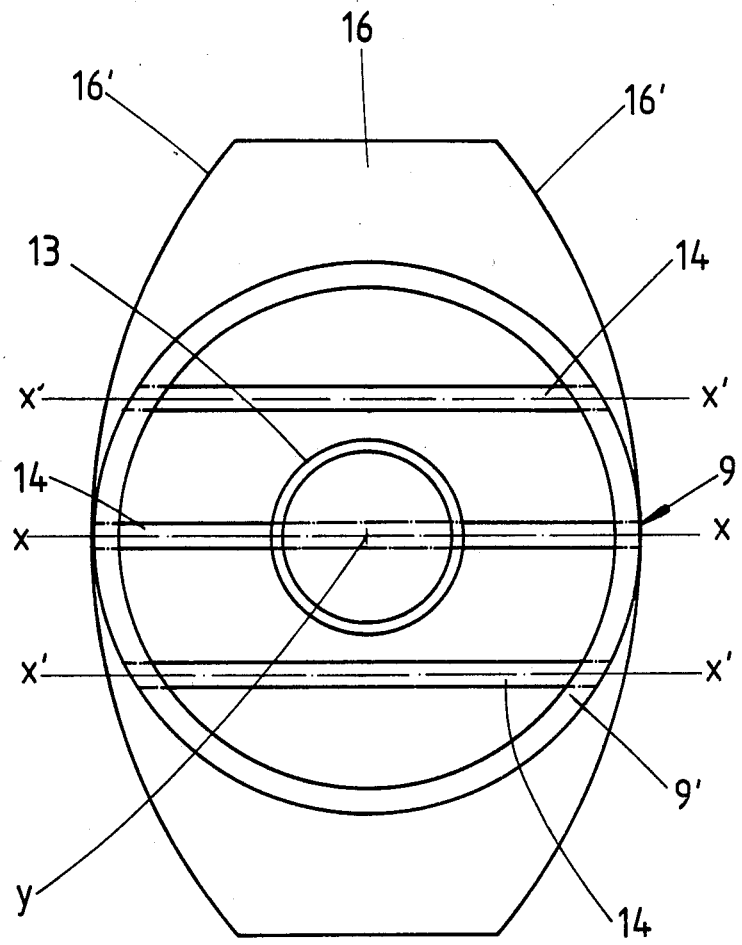
FIG. 11 shows a corresponding bottom view of a third embodiment of the plastic lid.
Figure 12:
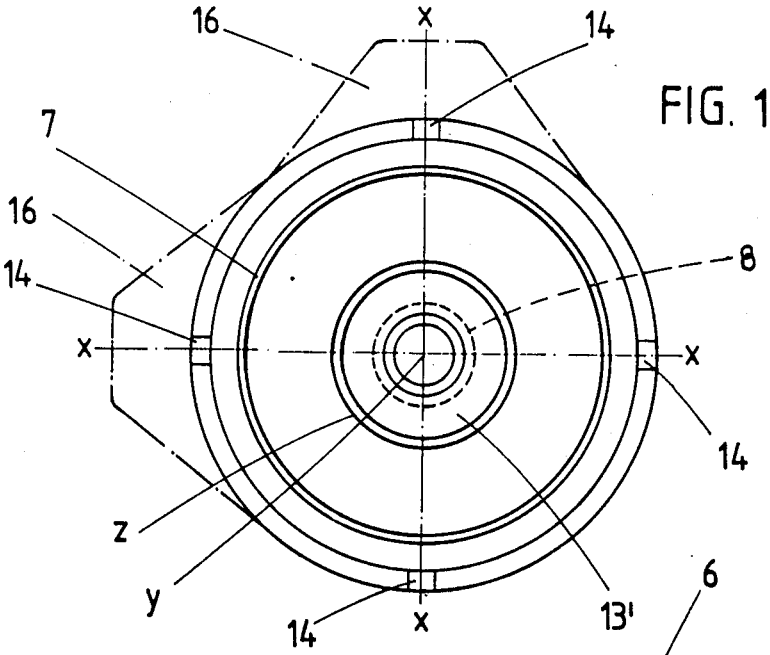
FIG. 12 is a bottom view of a closure cap in accordance with the fourth embodiment.
Figure 13:
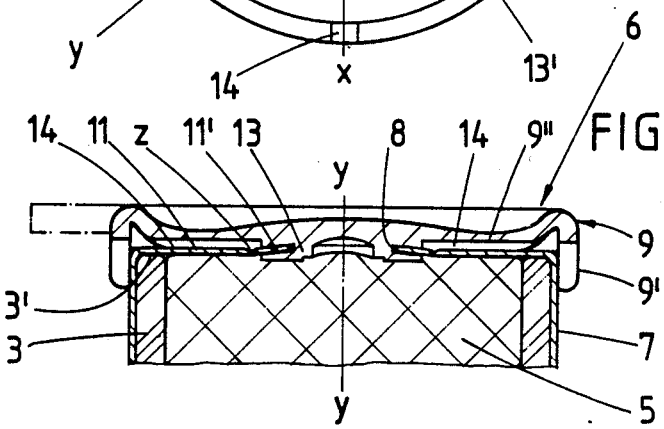
FIG. 13 is a vertical section through the cap-equipped rim neck of the infusion bottle.
Figure 14:
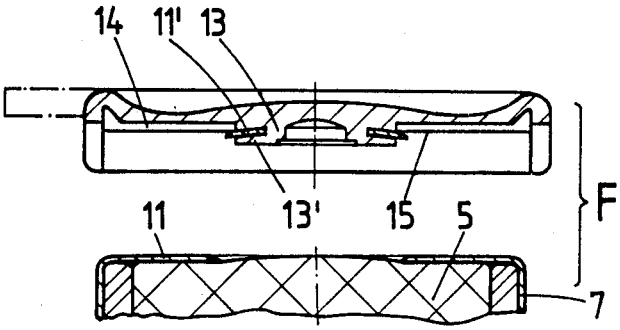
FIG. 14 is an identical figure with the plastic lid removed, showing the torn-out inner edge portion of the rim cap which has remained on the plastic lid.
Figure 15:
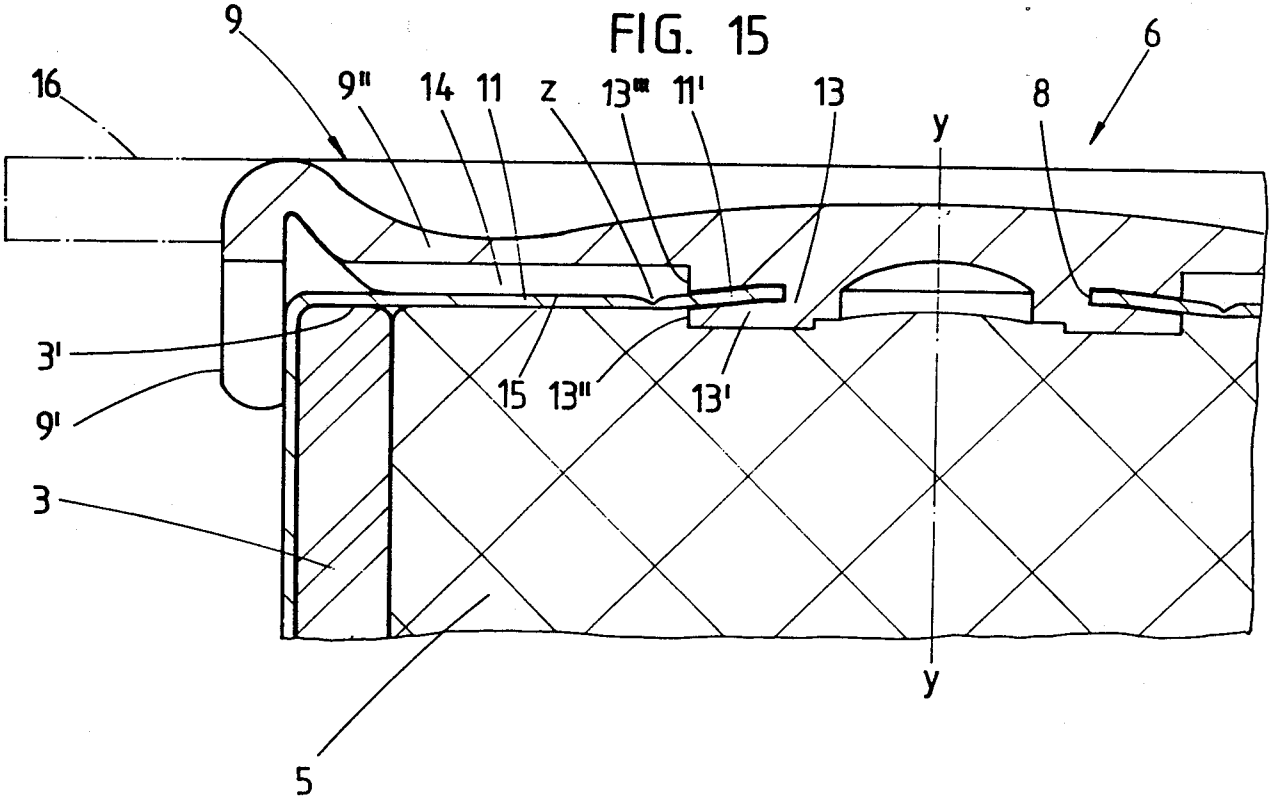
FIG. 15 is an enlarged view of a part of FIG. 13.

The embodiment shown in FIG. 11 differs from that shown in FIG. 10, in the manner that in this case, in addition, adjacent to the direction of the diametral intended-bend line x—x which intersects the longitudinal central axis y—y there extend parallel to said line additional intended-bend lines x'—x' whose continuous groove 14 now extends in the center of the corresponding half of the cover. The peripheral segment-shaped region of area of the plastic lid first lifts off, and is then followed, in chain-like fashion, by the section is integral with the annular collar 13, etc. The grooving can in this case also cut through the cup wall.

Figure 8:
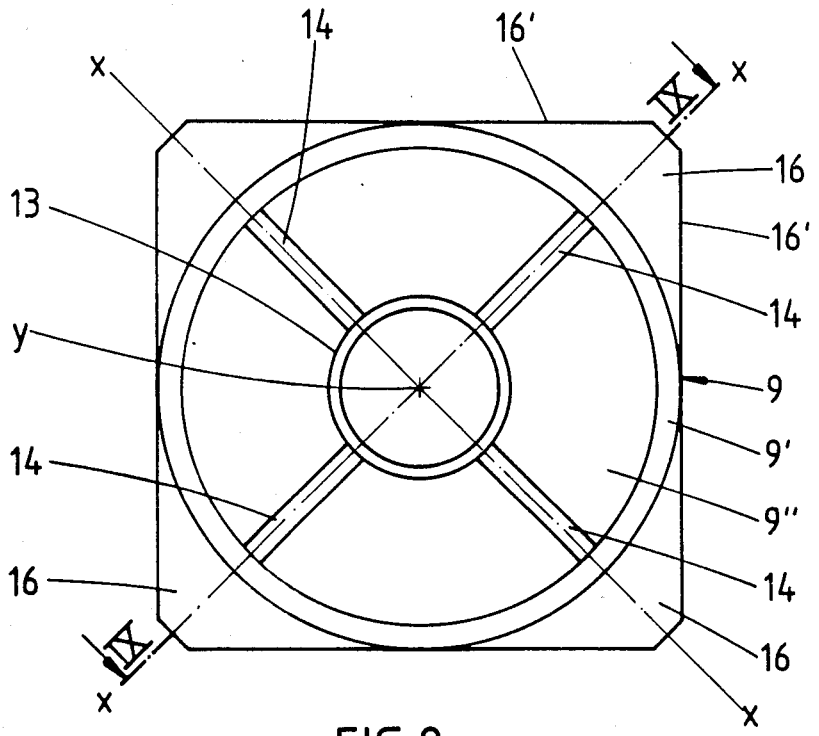
FIG. 8 shows the plastic lid of the second embodiment.

The embodiment shown in FIGS. 12 to 15 is developed with respect to the bottom grooving of the plastic lid 9 in the same manner as the preceding examples, particularly FIG. 8. The reference numbers have therefore been applied in analogous manner without repetitions in the text. The difference, however, is that outside of the collar portion 13' which engages below the edge portion of the central cutout 8 a circumferential tear line z is present in the cover 11 of the rim cap 7. This line extends concentrically to the edge of the central cutout 8. When of the plastic lid 9 is lifted off, the annular central cover section 11' fastened by the annular collar 13 of the plastic lid 9, is separated from the cover 11 of the rim cap 7. A clean separation is effected. In this way, there remains an even somewhat larger central cutout 8 in the cover 11 for the introduction of the injection needle.

The tear line z consists of an annular notched groove. The bottom of the groove terminates, with stressing of a fraction of the initial thickness of the cover 11, in front of the lower side of the cover. The corresponding groove embossing can be produced directly upon the deep-drawing of the aluminum rim cap. The annular cover section defined thereby rises slightly toward the center. A corresponding course is also taken by the top side of the plastic lid 9.

As a further development of the solution in accordance with FIG. 8, the groove 14 there also extends into the cup wall 9'. In a radially inward direction, the groove 14, however, terminates at the height of the outerward directed front end 13'' of the collar section 13'. In this plane, a lateral thickening of the annular collar 13 extends in vertical alignment. Its parallel outer annular surface is designated 13'''. The edge of the central cutout 8, formed by the inner section of the cover, experiences to this extent a stable gripping, and this occurs even with sealing effected on three sides.

I claim:

1. In a closure cap for infusion and transfusion bottles, which includes a rim cap adapted to grip around a rim neck of a bottle and wherein said rim cap has a central cutout which is closed by a central region of a plastic lid so that an annular zone of the plastic lid engages below an edge of the central cutout, the improvement comprising said plastic lid having at least one radially extending intended-bend line which is formed by a thinning of the lid material.

2. A closure cap according to claim 1, the improvement wherein said at least one radially extending intended-bend line comprises a plurality of diametrical intended-bend lines provided with equal angular spacing and extending diametrically from edge to edge of said plastic lid and through said central region.

3. A closure cap according to claim 1, the improvement wherein said at least one intended bend line is formed by a groove on a lower side of said plastic lid.

4. A closure cap according to claim 3, the improvement further wherein said plastic lid has an annular collar forming said annular zone, said plastic lid has a cup shape and has a cup wall, and said groove extends through the annular zone of the plastic lid, the central region circumscribed by said annular zone and the cup wall of the plastic lid.

5. A closure cap according to claim 1, the improvement further comprising said plastic lid has at least one grip tab which extends beyond the rim cap.

6. A closure cap according to claim 5, the improvement wherein the plastic lid has a cup shape, and said at least one grip tab is disposed at the level of a bottom surface of the plastic lid.

7. A closure cap according to claim 1, the improvement wherein said at least one radially extending intended-bend line comprises a diametrically extending intended-bend line, and a plurality of additional intended-bend lines adjacent to and extending parallel to the diametrally extending intended-bend line.

8. A closure cap according to claim 1, the improvement wherein said rim cap has a cover, said cover has an edge defining said central cutout, and a circumferential tear line located outside the edge of the central cutout in the cover of said rim cap, and said edge is gripped below by the annular zone of the plastic lid.

9. A closure cap according to claim 8, the improvement further wherein said tear line extends concentric to the edge of the central cutout.

* * * * *